US006046689A

United States Patent [19]

Newman

[11] Patent Number: 6,046,689

[45] Date of Patent: Apr. 4, 2000

[54] HISTORICAL SIMULATOR

[76] Inventor: Bryan Newman, 5300 Glenside Dr. Apt. 1610, Richmond, Va. 23228

[21] Appl. No.: 09/190,791

[22] Filed: Nov. 12, 1998

[51] Int. Cl.[7] ..... G08G 1/123

[52] U.S. Cl. ..... 340/996; 340/995; 340/990; 340/988; 701/200; 701/208; 395/173

[58] Field of Search ..... 340/996, 995, 340/990, 988; 701/200, 208; 395/173

[56] References Cited

U.S. PATENT DOCUMENTS

| | | | |
|---|---|---|---|
| 5,559,707 | 9/1996 | DeLorme et al. | 701/200 |
| 5,613,055 | 3/1997 | Shimoura et al. | 395/173 |
| 5,614,898 | 3/1997 | Kamiya et al. | 340/995 |
| 5,717,392 | 2/1998 | Eldridge | 340/996 |
| 5,848,373 | 12/1998 | DeLorme et al. | 701/200 |
| 5,862,498 | 1/1999 | Koyanagi et al. | 701/28 |
| 5,884,217 | 3/1999 | Koyanagi | 701/208 |
| 5,941,932 | 8/1999 | Aikawa et al. | 701/208 |
| 5,945,927 | 8/1999 | Nakayama et al. | 340/995 |

*Primary Examiner*—Benjamin C. Lee
*Attorney, Agent, or Firm*—Troutman Sanders LLP; Wm. Brook Lafferty

[57] ABSTRACT

A historical simulator which allows an individual using the device to access historically relevant information pertaining to a historically significant location the user is visiting. The user may readily access information regarding the historical location from a variety of information sources including databases in the Internet. The user may also view the retrieved information from a variety of different viewing modes and according to the individual user's selection from among a variety of information characterization variables.

9 Claims, 4 Drawing Sheets

HISTORICAL SIMULATOR

BACKGROUND

Annually, millions of people visit a multitude of locations of historical significance. Whether the individuals are tourists, archaeologists, students or the like, they share a basic interest. Namely, these people visit historically significant locations to learn about the past.

Simply being present at a historical location has limited informational benefit. Accordingly, those interested in improving the quality of such visits have long attempted to create devices and methods by which visitors could have more enjoyable and informative tours. Traditionally, knowledgeable individuals serving as tour guides, paper maps and permanent physical markers were the most commonly found (and most useful) aids to a visitor. In recent years, however, technological developments in information delivery systems have found their place into the tourism and education industries, promising more comprehensive and reliable delivery of information to the visitor. More specifically, recent technological advances have yielded information systems such as that taught in U.S. Pat. No. 5,717,392 (the '392 Patent), entitled "Position Responsive, Hierarchically-Selectable Information Presentation System and Control Program". As its title indicates, the invention of the '392 patent provides multimedia output that is responsive to a user's location, speed, acceleration and directional orientation. More specifically, the '392 patent advances the prior art by providing information to the user which is hierarchically arranged, i.e., the longer a user stays in a particular location of historical significance, the greater amount of progressively more detailed historical information is provided.

The '392 patent, for its advantages over the prior art, is frought with limitations which restrict the extent to which the available information can be tailored or customized by a visitor to best suit the visitor's interest, needs or desires. More specifically, the '392 patent teaches providing information to a recipient according to a hierarchical arrangement which has been established by someone other than the recipient. To the average recipient, this restriction might not be significant. However, to the more interested student, curious sightseer or avid scholar, the predetermined hierarchy will be frustrating. This limitation can best be illustrated by reference to a historical event which has recently been revived by Hollywood-the D-Day invasion of Normandy.

A tourist visiting the beaches of Normandy and utilizing a device drawn to the '392 patent would, during the journey along the beach, be periodically informed of noteworthy events which took place at various points along the beach. For example, a user might hear "at this location on day one of the invasion, the first American unit reached shore at approximately 8:15 a.m.". The student could continue along the beach and be informed of other similarly noteworthy events. In the alternative, the user could remain standing in the area where the above-referenced message was provided and, sensing lack of movement from the area, the hierarchically arranged system might provide further information, such as "this unit comprised 120 soldiers, 27 of whom survived the initial landing". If the user remained in the same location for yet another predetermined period of time, still more detailed information would be automatically provided, such as, "the soldiers who survived the landing were . . .".

The audible information referenced above is representative. The '392 patent also teaches presentation of visual and tactile information, also according to the same basic hierarchical configuration. That is to say, the longer an individual remains at a given point, the progressively more detailed information will be provided.

The '392 patent also teaches providing such hierarchically prearranged information responsive to a user's speed, acceleration and directional orientation. These additional factors notwithstanding, the information presented is still presented in a hierarchically arranged format whereby the specific hierarchy has been predetermined and is not subject to deviation by the user.

This is problematic if the user desires to selectively receive only certain information or if the user desires to "scroll" forward and backward within a certain body of information. More specifically, if a user's location triggered the system to present a combination of video and audio information, the user would be unable to view the video segment at a speed selected by the user, nor would the user be able to rewind the particular data and re-view the information again-maybe even at a different speed. Additionally, even if the user was able to locate the specific occurrence of a particular event, such as the landing of a particular unit on the beach, unless the information system was predesigned to include information about subsequent movement of the unit in the ensuing days, no such information would be available. Accordingly, a needing exists for an information delivery system which is not constrained in the delivery of information by predetermined hierarchical arrangements. There is an additional need for an information display system which allows a user to manipulate both the content and delivery of the information according to the user's own preferences, desires and interests.

SUMMARY OF THE INVENTION

The present invention meets the needs described above by providing a method and apparatus for selectively accessing and manipulating the presentation of historical information.

The system first determines which, if any, historical information should be accessed and presented to the user based on the user's geographical location. The user's geographical location may be determined by communication between a transmitter positioned on the person of the user and a global positioning system (GPS) satellite, or the like. Historical information is stored in a storage device either on the person of the user or at a central location. Once a user's position has been determined, the storage means can be accessed to determine whether there is information of historical significance within the system. If so, the user may retrieve the information to enhance the quantity and quality of the total amount of information available at the historical location.

Importantly, a user of the instant system enjoys great flexibility in both accession and manipulation of a variable information regarding the historical location. Specifically, the user is free to explore certain aspects of the available information in whatever depths the user desires, without any imposed restrictions as to which information can be accessed or excluded and without any limitation to the user's ability to access or dwell on a particular piece of historical information. For example, a user may transition effortlessly between an overhead schematic-type overview of a battle scene indicating positions and movements of units, recorded video footage and computer-generated animations of a particular scene.

A preferred embodiment of the present invention contains additional features, as well. Specifically, a user who is viewing, for example, a computer-generated animation of a particular battle scene can readily freeze the animation and then select from among a variety of "play" options; including rewind, fast forward, zoom, wide-angle and the like. Where appropriate, similar presentation options applied to the presentation of audio and tactile information.

In an embodiment of the present invention, the users access to information is not limited to information stored in the associated storage device. In such an embodiment, whatever information maybe stored in the associated storage device may be supplemented with the virtually unlimited informational resources available telephonically. One such available resource would, of course, be the Internet. Another such telephonically accessible resource might be historical associations or museums which maintain telephone numbers for the purpose of fielding questions and providing information of relevance to historical events. Still referring to the previously stated example of the D-day invasion of Normandy, an embodiment of the present invention is configured to provide cellular access to the Internet. Such capability may be provided either with "hard coded" lengths to relevant websites within the information stored in the storage device. During review of the information stored in the storage device, the user would be provided an indication that lengths to relevant websites exists and that the optional accessibility of these websites can be achieved by taking certain predetermined steps. In addition to, or in conjunction with these "hard coded" lengths, the present invention may provide access to an Internet searching tool, commonly referred to as a "web browser". The user would not then be limited to access to only "hard coded" lengths, but could freely search the Internet for any particular topic of interest, regardless of whether the system architect believed the information to be relevant or significant to the historical location.

DETAILED DESCRIPTION OF THE DRAWINGS

Figure 1:
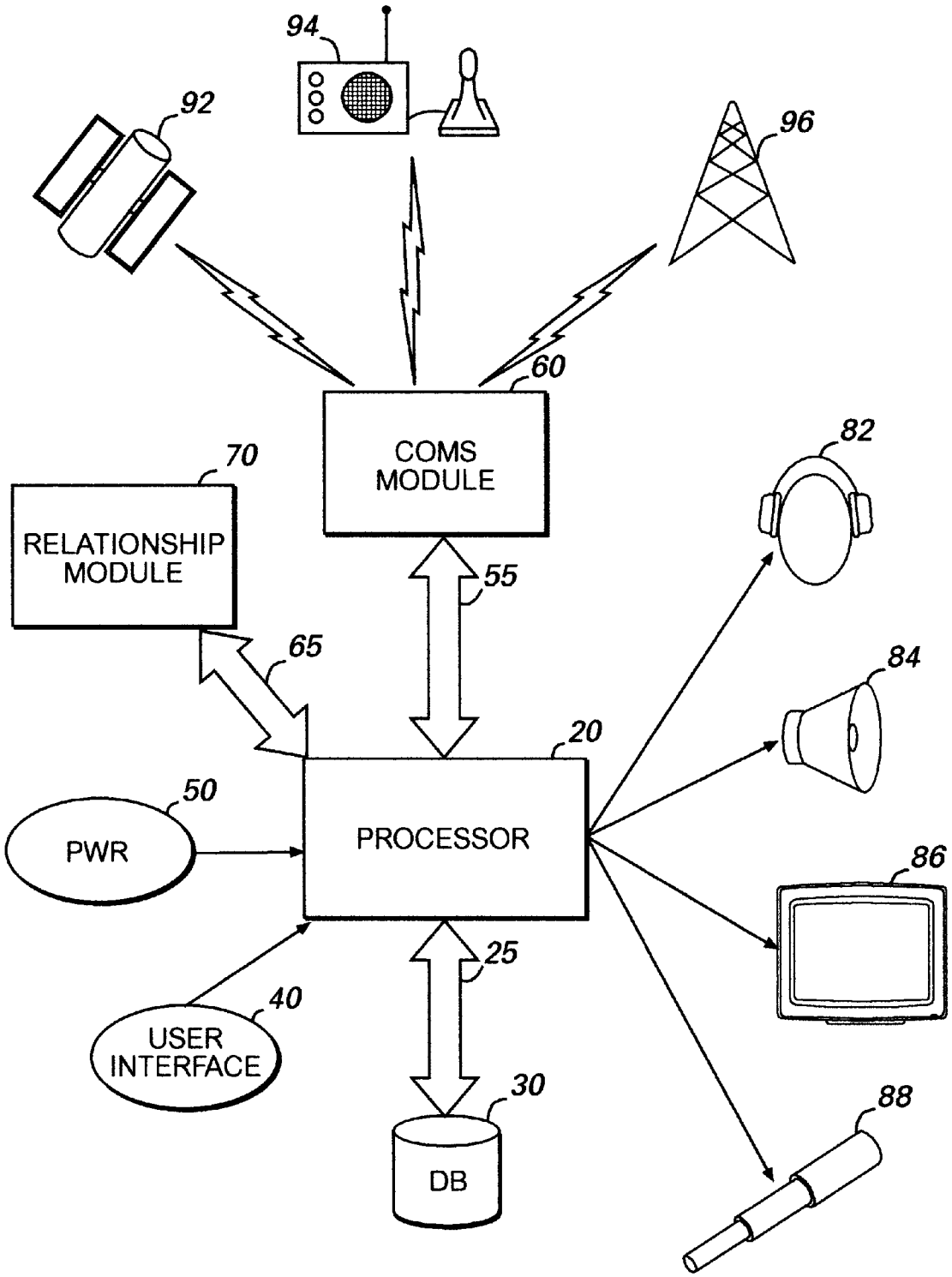
FIG. 1 is a system diagram of an exemplary environment for exemplary operation of the present invention.

Referring now to the drawings, FIG. 1 is an illustration of a preferred embodiment of the present invention, depicted in an preferred environment.

As can be seen in FIG. 1, the historical simulator 10 comprises, generally, a processor 20 from which a database 30 may be accessed by communicative interconnection 25. The processor 20 may be any one of a vast array of currently available processors, the specific requirements for which processor will be dictated, to a large degree, by the informational and communicative needs of the particular desired application. For instance, an application of the preferred embodiment of the present invention which simply allows access to so called "hard-wired" database sources would require less processing capability in a processor 20 than would an application which may be implemented to access information via the Internet, as later described.

Similarly, the requirements for the database 30 will also vary greatly depending on the particular needs of a particular application. For example, a substantial amount of "base" information may reside on a hard-wired hard drive. Additional database sources, could, of course, be media such as a floppy disk, compact disk or the like.

A preferred embodiment of the present invention will also include a user interface 40 for initiating requests and commands to the processor 20. More specifically, the user interface 40 may be any apparatus by which user requests, or commands can be provided, to the processor including, but not limited to, a traditional alpha numeric keypad, on-screen touch "sensors", voice recognition, joy stick, mouse or the like. Although the present invention contemplates an embodiment wherein no user interface is required, it will be understood and appreciated that a significantly greater range of flexibility of use may be achieved by the presence of such a user interface 40.

The historical simulator 10 requires a source of power as indicated in FIG. 1 by power source 50. Although depicted in FIG. 1 as a single power source 50, power may be supplied to the processor by any variety in any number of commonly available power supply means. For instance, the power supply 50 may comprise a battery, a generator, solar cells, or any combination of these, or other well known power sources. It will also be understood and appreciated that the interconnection between the power source 50 and the historical simulator 10 can occur at any one of several locations without creating any material difference in the operation or the operability of the invention.

The communications module 60 is communicatively interconnected to the processor 20 via communications link 55. Because a preferred embodiment of the present invention provides communication capability of multiple types with multiple sources, the communications module 60 will comprise necessary elements to achieve the desired communications results. For example, in a preferred embodiment of the present invention, the historical simulator 10 may have the capability of communicating with a global positioning system, (GPS)-type satellite 92, a "local" base station 94 and a cellular telephone network 96.

To support GPS-type communication between the communications module 60 of the historical simulator 10 and the GPS satellite 92, an appropriate and well known transceiver would necessarily be a component of the communications module 60. As signals are transmitted from a GPS-type transceiver to and from a satellite 92, the position determining information is relayed from the communications module 60 to the processor 20 via communications link 55. The processor then compares the reported position data to corresponding historical position data (if any) contained in the database 40 to determine if historical information relating to the user's current position is available for presentation to the user.

The communications module 60 may also comprise a transmitter, receiver or transceiver for communicating with a "local" base station 94. The capabilities of the communicative link between the historical simulator 10 and a base station 94 are somewhat analogous to a "walkie-talkie" link, whereby the operator of the historical simulator 10 may contact a particular guide or information office from which the user's individual tour may be based. An example of the usefulness of this capability is demonstrated when a user who is using the historical simulator 10 for the first time is unable to access more detailed information, despite an indication from the historical simulator that such detailed information exists. The user may wish to communicate directly with an individual at the park or battle field office, which individual may be located at a central office or tour facility and may be operating a base station 94, to ask for guidance.

An alternate embodiment of the present invention may include a relationship module 70 communicatively interconnected to the processor 20 via communication link 65. The relationship module 70 may allow limited remote control of the processor 20 by another device, such as that which might be carried by a tour guide. Such a relationship might be of the well know "master/slave" variety and could enable a tour guide to control, to a varying extent, the information viewed by the user.

Yet another desired capability of a preferred embodiment of the present invention is the ability to communicate telephonically. As the capabilities and capacity of telephonic communication devices and services increase rapidly, the usefulness of such telephonic capability in the context of the present invention is apparent. It could be most useful for a user of the historical simulator to place a telephone call to a local authority via equipment maintained in the communication module 60. Such telephone equipment is most likely of the cellular type and is capable of accessing a cell site 96. Thereafter, the cell phone component of the communications module 60 accesses a cellular telephonic network for the purpose of calling local authorities, such as a local Chamber of Commerce, the Smithsonian Institution, or the local chapter of the Daughters of the American Revolution—for information specific to a particular historical location. Even more compelling, though, is the recent advent and improvement to cellular technology which enables access to the Internet. Recent advances in such systems are discussed, for example, in the article entitled "Europe's Future Mobile Telephony System" by William Johnston, which article was published in the October, 1998 issue of the IEEE Spectrum, the monthly magazine of the Institute of Electrical and Electronics Engineers, which article is specifically incorporated hereby by reference.

Still referring to FIG. 1, a variety of mechanisms for delivering retrieved information to the user are identified. As representative example, information may be by headphones or speaker 82 or by a sub-acoustic bass "thump" provided by a bass shaker device 84 to simulate battlefield percussion. Video information may be provided to the user via video display 86. Orientation-specific video information may be provided to the user via telescope 88. While information outputs 82, 84 and 86 are well known to those in the art, orientation-specific telescope 88 requires additional explanation.

The orientation-specific telescope 88 is capable of determining the specific direction that the telescope is being pointed (both horizontal and vertical angles) by well known orientation determining means. This orientation information, in addition to the position location of the user (as identified through the GPS-type functionality of the historical simulator in communication with the satellite 92) allows a determination as to which information in the information database 30 the user should be seeing when looking through the telescope 88 in a particular direction. Initially, the telescope 88 will allow the user to view whatever it is actually that he is actually looking at. This, for instance, may be a particular portion of land where a historical event took place.

If, during a relevant and historically significantly time, a certain structure was previously at that location, and if a graphic representation of that structure is located in the database 30, a user standing on the particular location and orienting the telescope 88 toward the now non-existing structure, processor 20 could access the database 30 to retrieve a graphic image of the fallen structure, transmit the image to a transparent viewing screen within the telescope 88 so that the user, when viewing the landscape as it current exists, would see a graphic representation of the fallen structure transposed on top of the actual current terrain.

Figure 2A:
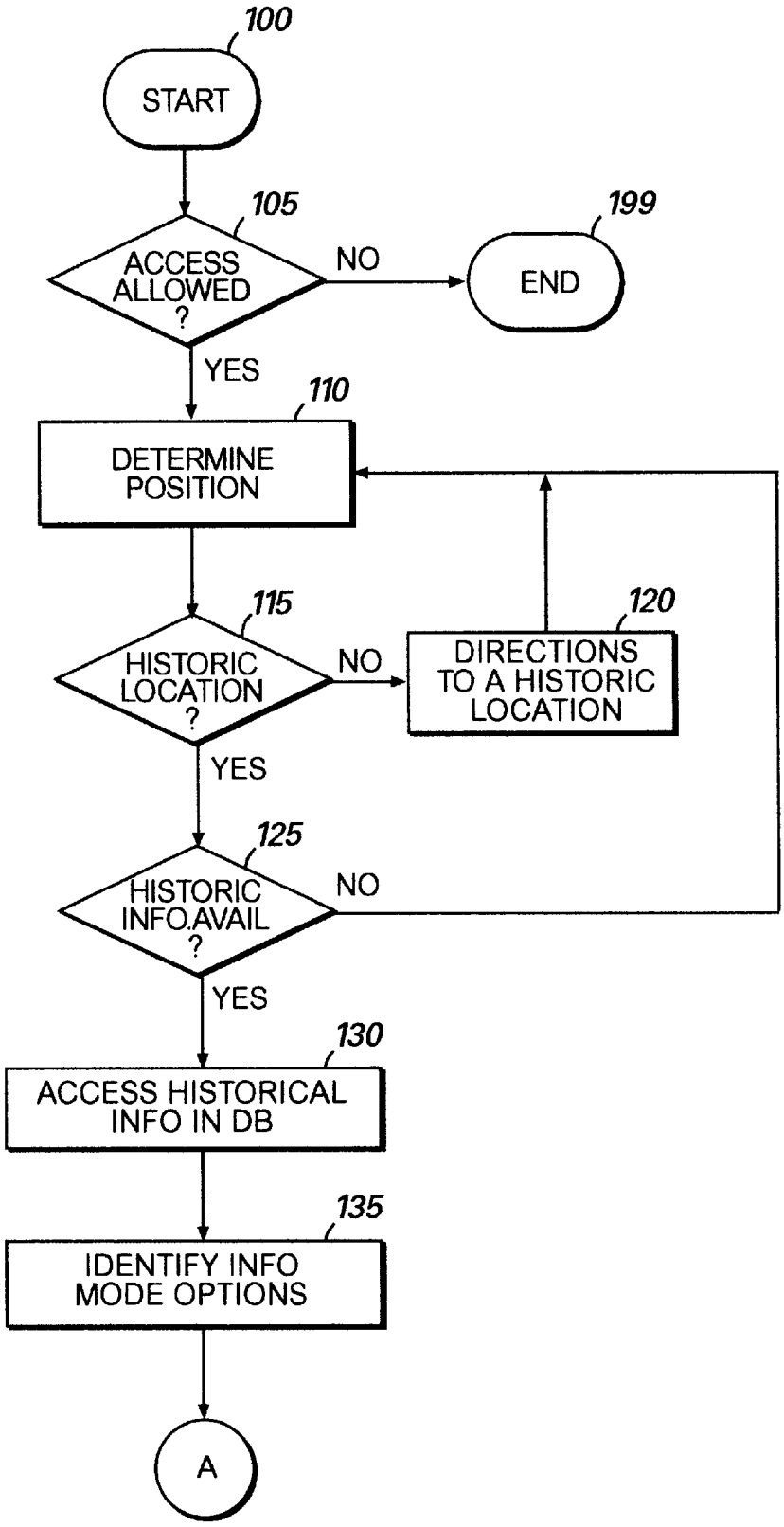
FIGS. 2*a–b* are flowchart illustrating a general exemplary method of the present invention as it relates to utilization of the exemplary method of the present invention.
Figure 2B:
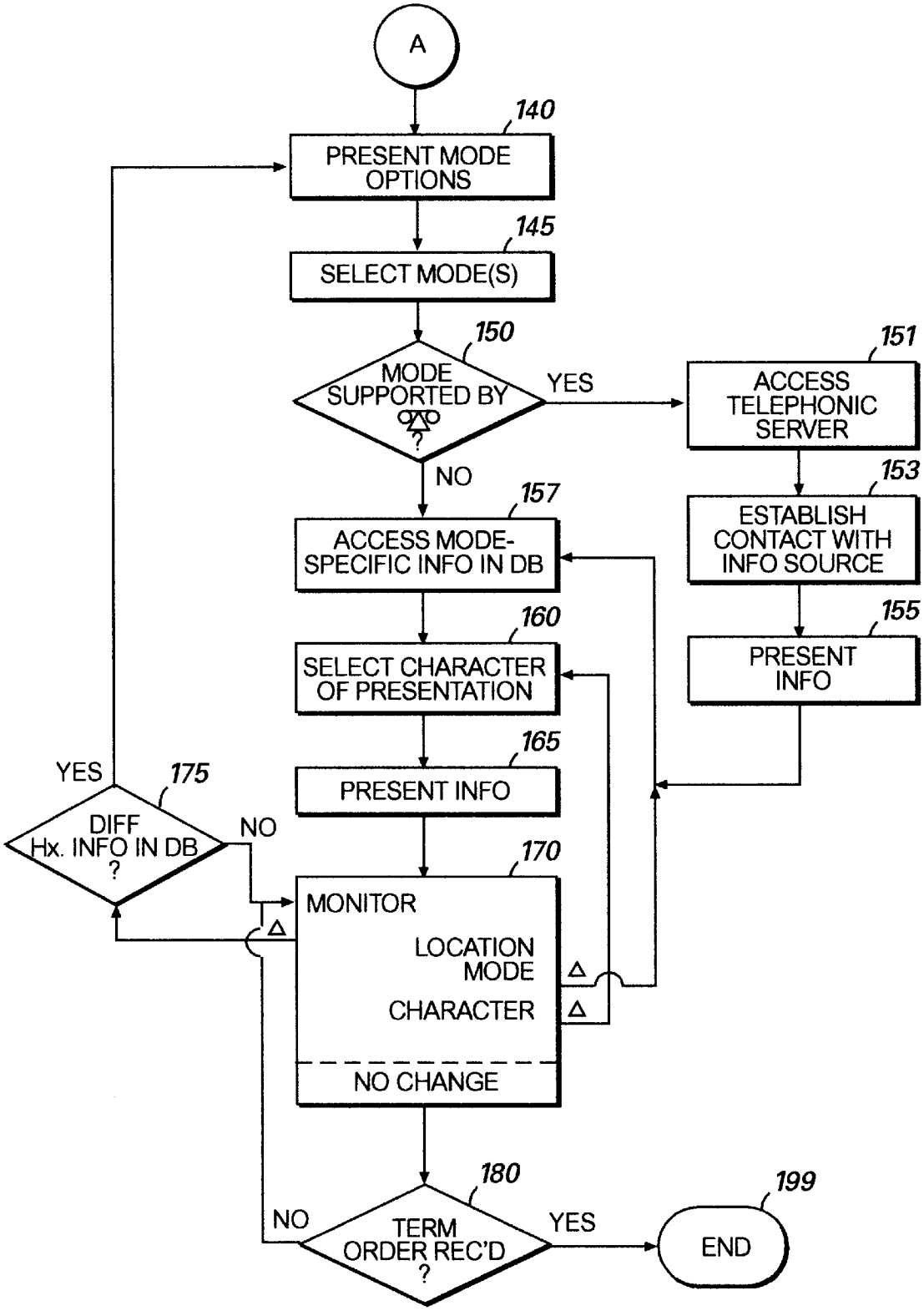

FIGS. 2*a* and 2*b* are a flow chart illustrating a general method for utilization of the historical simulator to provide information to a user regarding a particular historical event at a particular historical location. In other words, FIGS. 2*a* and 2*b* depict an exemplary method of implementation of the system described in FIG. 1.

More specifically, FIG. 2*a* depicts an exemplary embodiment of the present invention in which the method begins at step 100 and, at decision block 105, a determination is made as to whether use of the system by a user has been authorized. Specifically, a determination as to whether access to the system of the present invention will be allowed can be made by a multitude of different access limitation devices, including but not limited to a temporarily issued personal identification number (PIN), a key or an embedded pass code that can be turned on or off by the facility providing the system to a user on a temporary basis, or a "dongle". If access is not allowed, the method ends at step 199. If access is allowed, the system determines its present position at step 110, preferably by interactive communication between the communications module 60 and the GPS-type satellite 92. Once a position has been determined, a further determination is made as to whether the user's current position corresponds to a historical location which has been noted in the database 30 at decision block 115. If no recorded historical information corresponds to the user's present location, directions may be provided, at step 120, to historical locations within a predetermined proximity. If the user's present location does correspond to a noted historical location, an inquiry will be made as to whether historical information corresponding the historical location is available, as shown at decision block 125. If there is no available historical information, the steps of determining the user's present position (step 110) through determining what other historical information is available (step 125) will be repeated until such time as historical information corresponding to the user's present location is available.

If historical information corresponding to the user's present position is available, the information will be accessed at step 130 and, depending on the volume and nature of the information, the system will identify, at step 135, all available information presentation mode options for the relevant historical information. For example, certain relevant historical information relating to the user's current position may comprise video, audio and tactile information. Each of the video, audio and tactile portions of information are considered different "modes". Once the available modes have been identified at step 135 and, thereafter, presented to the user in the form of mode options at step 140 (referring now to FIG. 2*b*), the user may select a desired mode for presentation of the information. In the preferred embodiment, and when the appropriate situation presents itself, the user may prefer to utilize more than one presentation mode at a time, but less than all of the presentation modes. For instance, a user touring a civil war battle field who previously enhanced his historical experience by consuming large quantities of "hardtack" and warm beer as did civil war era soldiers, might not be interested in the tactile sensation of an artillery percussion simulating bass thump emanated by a bass shaker 84. Accordingly, the user could select from among the available mode options to simply receive video and audio output from the system 10.

At decision block 150, an inquiry is made as to whether information relating to a particular mode is supported by telephonic communication. If not, the method of the present invention continues with the processor 20 accessing relevant information in the database 30 via communicative interconnection 25. If, on the other hand, information such as Internet links or the like are integral to a particular information presentation mode, a well known telephonic server within the communications model 60 is accessed at step 151 so that, at step 153, contact with the information source is achieved, and thereafter, at step 155, the information accessed via a telephonic communication is presented to the user. As indicated, as this telephonically accessed communication is presented to the user, the method of the present invention continues at step 157 with accessing mode specific information in the database. Once all such information has been accessed, the user is presented with available options by which the character of the presentation of information may be determined, shown at step 160. In the context of a preferred embodiment of the present invention, characterization variables from which a user may be able to select include perspective, graphics, animation, video, time compression, and other variables. The user selects characterization variables for controlling the presentation of the information and, at step 165, the information is presented in accordance with the user's selections. During and after presentation of the information according to the user's selected characterization variables, system status is monitored by the processor 20, depicted in step 170. Representative of the many aspects of the information presentation which are monitored are the location of the user, the mode of presentation of information, and the characterization of presentation of information. If the system detects a change in the location of the user, a system inquiry occurs regarding whether different historical information is present in the database relating to the user's new location, depicted at step 175. If not, the system continues its monitoring process at step 170. On the other hand, if different historical information is present, the steps of presenting mode options related to the different historical information (step 140) through the step of the system monitoring itself (step 170) are repeated.

If the user indicates a desire to change a mode of presentation of information, the steps of accessing information related to the newly chosen mode (step 157) through the step of monitoring the system (step 170) are repeated.

If the system, while monitoring itself at step 170, detects the user's desire to change the character of presentation of the information, the steps of selecting the character of the presentation of information (step 160) and the step of monitoring the system (step 170) are repeated.

In the event that the system does not detect change of any type, decision block 180 inquires as to whether a termination order has been received from any source, be it the user, the system, or a supervisory person or facility, as shown at step 180. If no termination order has been received, the system continues to monitor itself at step 170. If a termination order has been received, the method ends at step 199.

Figure 3:
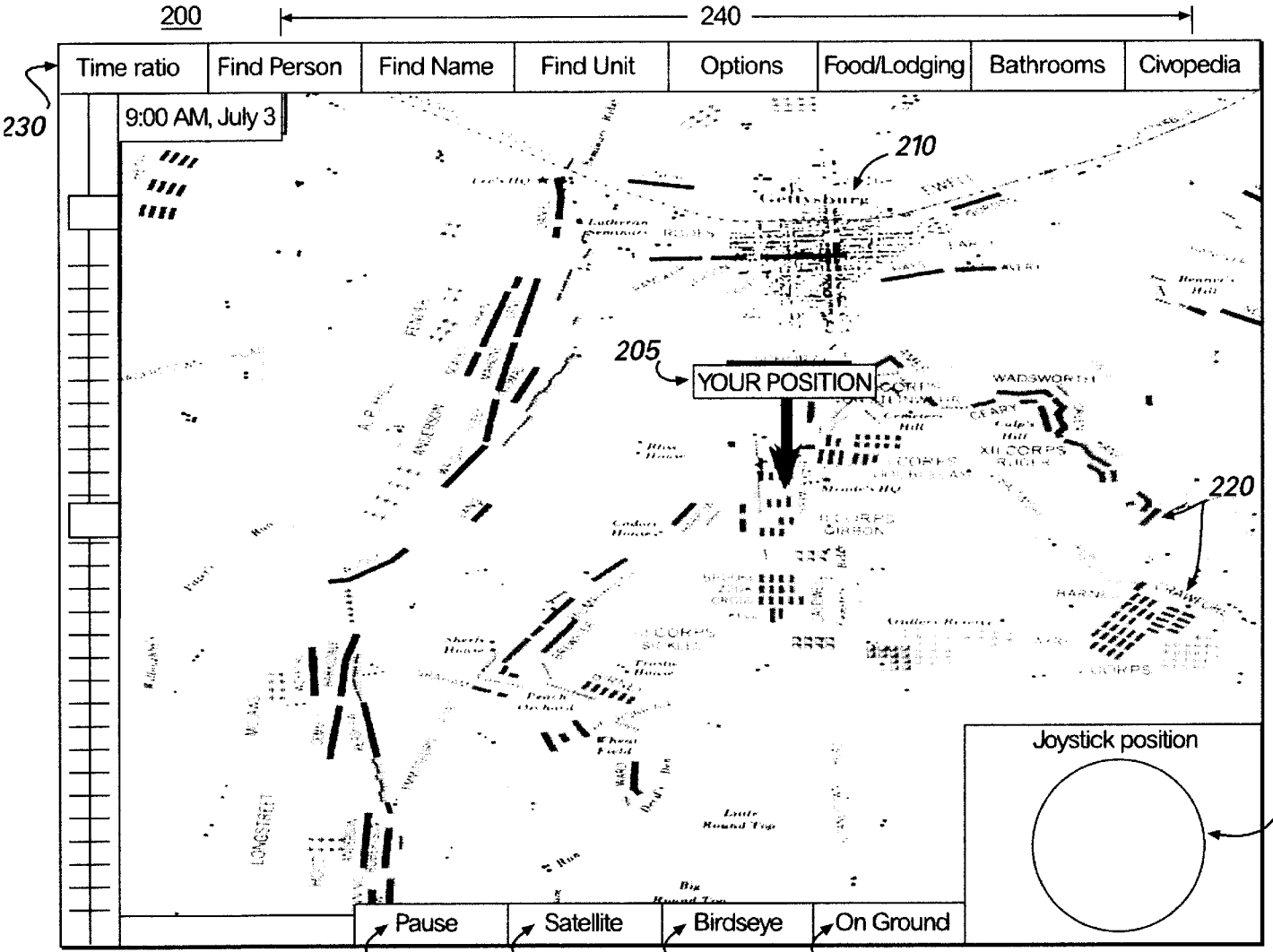
FIG. 3 is a screen shot illustrating a general exemplary implementation of an exemplary embodiment of the present invention.

FIG. 3 is a representative screen shot of a video display such as that which a user of the present invention might see while implementing the present invention to assist in a tour of a historic location. Examination of FIG. 3 indicates depiction of a particular historically significant location. In this representative case, the town of Gettysburg, Va. shortly before the infamous civil war battle.

In accordance with previously identified steps of the method of the present invention, the physical position of the user 205 has been determined and is identified on the video display screen 200. In this representative case, the position of the user is in a historically significant area and, therefore, information pertaining to the historical event relating to the historical location is presented. In this example, the town of Gettysburg 210 is identified on the video display, in addition to an indication as to the user's position 205 and the positions of military units and other points of interest 220 during the relevant historical time period. As the user's position 205 changes, the relative relation of the user and his surroundings 210, 220 will change to indicate such movement.

If, during presentation of the information, the user desires different information regarding the historically significant location, character and characterization variables may be changed by actuation of characterization and characterization variable selection means 230. In the depicted example, the user may select between character and characterization variables relating to the perspective from which the historically significant data is viewed and from options relating to the time ratio of the display. For instance, should a user desire to speed up the depiction of events which transpire during the battle, the user would select the "time ratio" category and make an appropriate adjustment. Similarly, if a user desired a closer view of a particular aspect of the event, a selection could be made as between satellite, birds eye, and "on ground" options.

Additionally, other information could be presented to a user readily using the same format. For instance, additional category information 240 can also be made available to a user. Such information is limitless in variety and might include information relating to particular people of significance, the nearest restroom or the like.

Finally, an embodiment of the present invention may contain a joystick-type device 250 by which a user may easily maneuver through the varying views of the historical event.

Importantly, it will be understood and appreciated that such a video display is not limited to information of the type depicted in FIG. 3 and will optically be able to facilitate not only topographical information displays, but also various other video types, including animation and vintage footage, along with textual material.

I hereby claim:

1. An apparatus for providing multimedia information to a user, the system comprising:

(a) position determining means for determining the position of the user;

(b) storage means for storing multimedia information;

(c) retrieval means for retrieving multimedia information from the storage means;

(d) selection means for selecting the character and characterization of the multimedia information retrieved by the user, the character and characterization of the retrieved multimedia information being selected by the user according to predetermined character and characterization variables;

(e) presentation means for presenting the retrieved multimedia information to the user in accordance with the predetermined character and characterization variables;

wherein the character and characterization variables comprise: perspective, graphic, animation, time compression, audio and non-acoustic sensory (tactile).

2. The apparatus of claim 1, wherein the positioning determining means is a Global Positioning System-type device.

3. The apparatus of claim 1, wherein the retrieval means retrieves multimedia information from associated computer-readable databases.

4. The apparatus of claim 1, wherein the retrieval means retrieves multimedia information via a wireless link.

5. The apparatus of claim 4, wherein the wireless link is cellular.

6. A method for selectively accessing and manipulating the presentation of historical information, comprising the steps of:

(a) identifying a location of historical significance by comparing a position location to a database containing historically significant location zones and, if a correspondence between the position location and one or more historically significant location zones exists, allowing further access to the database;

(b) retrieving from the database information relating to a historically significant event which occurred in proximity to the historically significant location zone corresponding to the position location;

(c) selecting the mode of presentation of the information relating to the historically significant event;

(d) selecting the character of the information presented by selecting between predetermined character and characterization variables; and (e) receiving the historical information; wherein the step of selecting the character of the information presented by selecting between predetermined character and characterization variables comprise the further step of selecting between perspective, graphic, animation, time compression, and audio character and characterization variables.

7. The method of claim 6, wherein the step of selecting the mode of presentation of the information relating to the historically significant event further comprises the step of selecting a mode of presentation from a group of presentation options comprising: video, audio and tactile.

8. The method of claim 6, comprising the further step of manipulating the character and characterization variables during presentation of the historical information to immediately alter the presentation of the historical information accordingly.

9. The method of claim 6, comprising the further steps of:

(a) periodically monitoring the position location to determine a new position location;

(b) periodically updating the position location to reflect the new position location;

(c) periodically comparing the new position location to the database containing historically significant location zones and, if a new correspondence between the new position location and one or more new historically significant location zones exists, allowing access to the database information relating to the new historically significant location zones.

* * * * *